US008075014B2

(12) United States Patent
Phibbs

(10) Patent No.: US 8,075,014 B2
(45) Date of Patent: Dec. 13, 2011

(54) SNOWBOARD OR SKI OR THE LIKE HAVING A CHANNELED EDGE OR MULTIPLE ELEMENT EDGE

(75) Inventor: Peter F. Phibbs, Poulsbo, WA (US)

(73) Assignee: Peter F. Phibbs, Agana Heights, GU (US)

( * ) Notice: Subject to any disclaimer, the term of this patent is extended or adjusted under 35 U.S.C. 154(b) by 421 days.

(21) Appl. No.: 12/245,504

(22) Filed: Oct. 3, 2008

(65) Prior Publication Data

US 2009/0102161 A1 Apr. 23, 2009

Related U.S. Application Data

(60) Provisional application No. 60/977,624, filed on Oct. 4, 2007.

(51) Int. Cl.
*A63C 5/04* (2006.01)

(52) U.S. Cl. ..... 280/609; 280/608

(58) Field of Classification Search ..... 280/608, 280/609, 610, 11.18, 28, 607, 601, 14.21, 280/14.22, 14.1, 18
See application file for complete search history.

(56) References Cited

U.S. PATENT DOCUMENTS

| | | | | | |
|---|---|---|---|---|---|
| 4,533,150 | A * | 8/1985 | Hardy | 280/14.28 |
| 5,083,810 | A * | 1/1992 | Minidis | 280/608 |
| 5,301,965 | A * | 4/1994 | Floreani | 280/600 |
| 5,462,304 | A * | 10/1995 | Nyman | 280/609 |
| 6,062,585 | A * | 5/2000 | Hess | 280/608 |
| 6,308,978 | B1 * | 10/2001 | Kelman | 280/608 |
| 7,073,810 | B2 * | 7/2006 | Wilson | 280/609 |
| 2004/0169349 | A1 * | 9/2004 | Park | 280/608 |

FOREIGN PATENT DOCUMENTS

| | | | |
|---|---|---|---|
| JP | 55052776 | A | 4/1980 |
| JP | 56063475 | U | 5/1981 |
| JP | 62024880 | U | 2/1987 |
| JP | 62174573 | U | 11/1987 |
| WO | 2009/046332 | A2 | 4/2009 |
| WO | 2009046332 | A3 | 7/2009 |

OTHER PUBLICATIONS

International Search Report for PCT Application No. PCT/US2008/078796 mailed on Jun. 2, 2009, 10 pages.

* cited by examiner

*Primary Examiner* — J. Allen Shriver, II
*Assistant Examiner* — James M Dolak
(74) *Attorney, Agent, or Firm* — Cool Patent P.C.

(57) ABSTRACT

Briefly, in accordance with one or more embodiments, a snowboard or ski or the like comprises a base body having at least one edge, a top surface and a bottom surface; wherein the edge comprises at least one channel formed therein to provide two or more edge elements to contact a medium during use.

15 Claims, 8 Drawing Sheets

SNOWBOARD OR SKI OR THE LIKE HAVING A CHANNELED EDGE OR MULTIPLE ELEMENT EDGE

CROSS REFERENCE TO RELATED APPLICATIONS

The present application claims the benefit of U.S. Provisional Application No. 60/977,624 filed Oct. 4, 2007. Said Application No. 60/977,624 is hereby incorporated by reference in its entirety.

BACKGROUND

Snowboards or skis or the like are typically constructed of a main body comprising a wood core, and one or more layers of fiberglass, plastic or resin. A metal edge is provided along the edge of the body to provide friction between the board and the medium such as snow, ice, or water, during maneuvering. However, the simple metal edge may provide a limited amount of catching of the medium, which may limit the performance of the snowboard or ski or the like during more extreme turning or maneuvering.

DESCRIPTION OF THE DRAWING FIGURES

Claimed subject matter is particularly pointed out and distinctly claimed in the concluding portion of the specification. However, such subject matter may be understood by reference to the following detailed description when read with the accompanying drawings in which:

Figure 1:
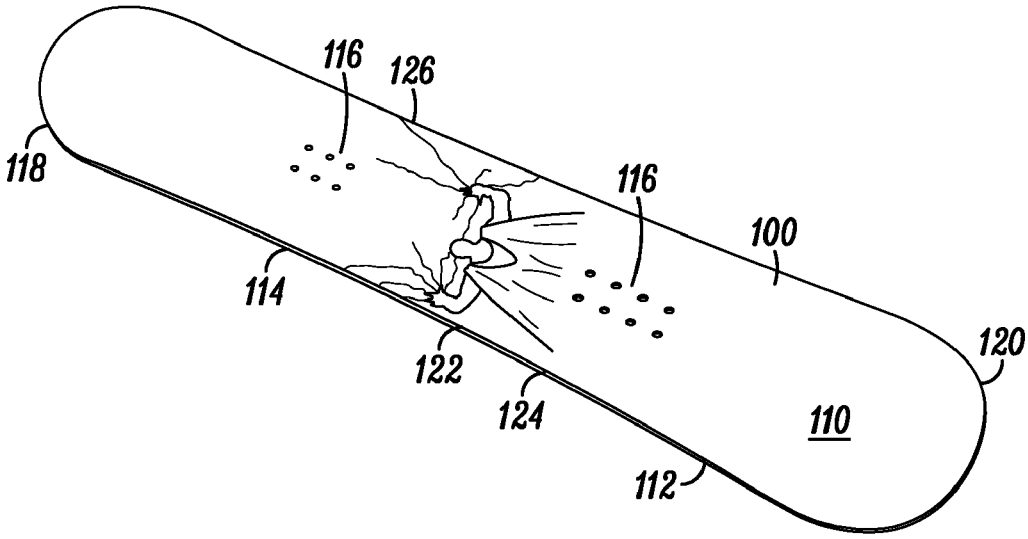
FIG. 1 is a top plan view of a snowboard or ski or the like in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or circuits have not been described in detail.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. For example, "coupled" may mean that two or more elements do not contact each other but are indirectly joined together via another element or intermediate elements. Finally, the terms "on," "overlying," and "over" may be used in the following description and claims. "On," "overlying," and "over" may be used to indicate that two or more elements are in direct physical contact with each other. However, "over" may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect. In the following description and/or claims, the terms "comprise" and "include," along with their derivatives, may be used and are intended as synonyms for each other.

Referring now to FIG. 1, a top plan view of a snowboard or ski or the like in accordance with one or more embodiments will be discussed. As shown in FIG. 1, snowboard 100 comprises a generally planar instrument having an upper surface 110 and a lower surface 112. Although FIG. 1 shows a snowboard 100 for purposes of discussion, snowboard 100 may likewise comprise a ski or the like, and may be designed for use in the snow or alternatively may be designed for use in the water or any fluid material or other medium suitable for motion or travel. For purposes of discussion, snowboard 100 will be referenced, although the scope of the claimed subject matter is not limited in this respect.

In one or more embodiments, snowboard 100 generally may have a first or left edge 114, and a second or right edge 126. Snowboard 100 may comprise one or more mounts 116 for attaching one or more bindings into which a user may secure his foot or feet for riding and/or controlling snowboard 100 during use. Snowboard 100 may have a front end 118 which may be the leading end during motion of snowboard 100, and may comprise a rear end 120 which may be the leading end during motion of snowboard 100. In one or more embodiments, a user of snowboard 100 may manipulate the snowboard 100 during use that that the rear end 120 may become the leading end and the front end 118 may become the trailing edge during motion, and in some instances the user may alternate between the front end 118 and the rear end 120 as the leading end during use, and the scope of the claimed subject matter is not limited in this respect.

In one or more embodiments, snowboard 100 may have one or more bindings or edging 122 along first edge 114 and/or second edge 126. The edging 122 may comprise a metal or similar material such as steel or carbon fiber to provide rigidity and/or structural strength along the edges 114 or 126 during use, while in some embodiments also providing a predetermined amount of flexibility. In general, edging 122 may be used to assist the user of snowboard during turning and to grip into snow and/or ice to mitigate or control slipping. In one or more embodiments, snowboard 100 may include one or more channels 124 disposed along first edge 114 and/or second edge 126 to provide additional control of snowboard 100 during turning and/or controlled sliding and stopping. Embodiments of one or more channels 124 are described in further detail, below.

Figure 2:
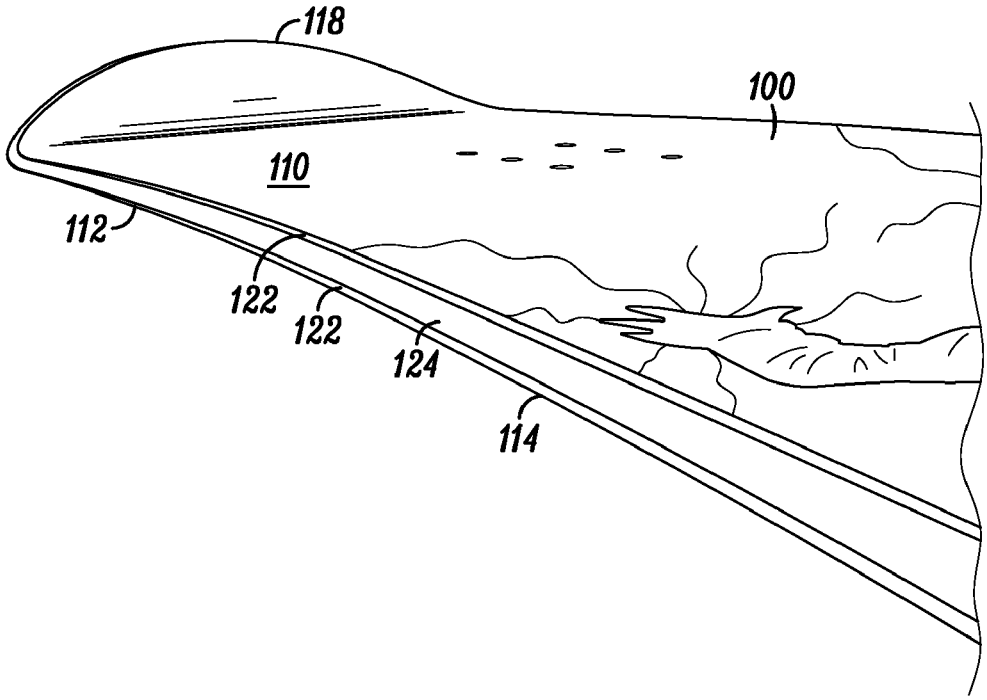
FIG. 2 is an isometric view of a snowboard or ski or the like in accordance with one or more embodiments.

Referring now to FIG. 2, an isometric view of a snowboard or ski or the like in accordance with one or more embodiments will be discussed. FIG. 2 shows snowboard 100 having a channel 124 disposed along an edge 114 thereof. In one or more embodiments, channel 124 may be disposed generally adjacent to edging 122, and in some particular embodiments may be disposed between an upper edge 122 and a lower edge 122. In some embodiments, channel 124 may generally run for a partial length along one or more edges 114 or 126 of snowboard 100, and in some embodiments channel 124 may generally run for a substantial length of one or more edges 114 or 126. However, these are merely example lengths of channel 124, and the scope of the claimed subject matter is not limited in this respect.

Figure 3:
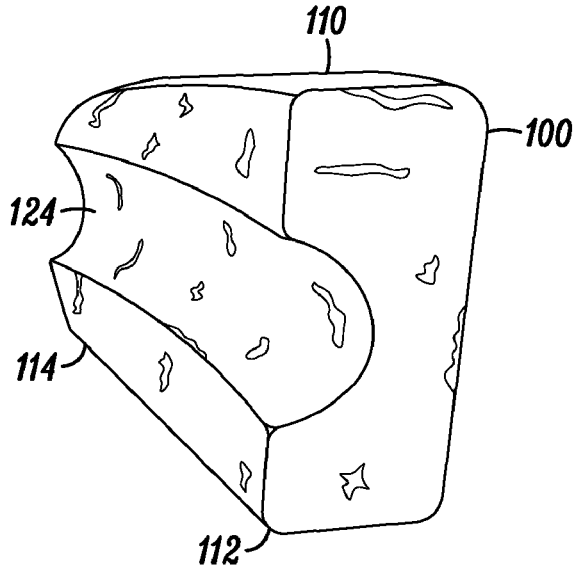
FIG. 3 is an isometric view of a curved channel formed in a snowboard or ski or the like in accordance with one or more embodiments.
Figure 4:
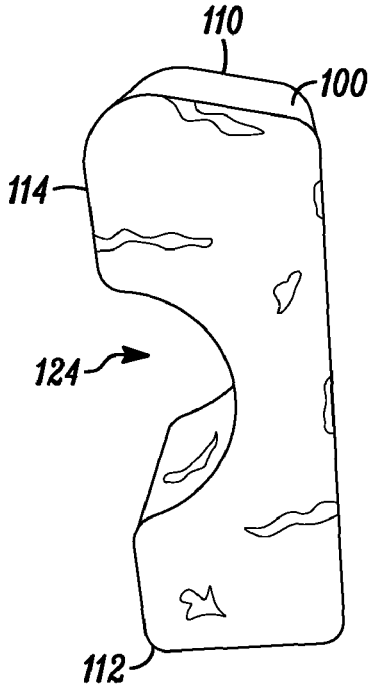
FIG. 4 is an edge view of a curved channel formed in a snowboard or ski or the like in accordance with one or more embodiments.

Referring now to FIG. 3 and FIG. 4, an isometric view and an edge view of a curved channel formed in a snowboard or ski or the like in accordance with one or more embodiments will be discussed. FIG. 3 illustrates a portion of a snowboard 100 for purposes of modeling and discussion. Channel 124 may generally comprise a curved or groove shape running for at least a partial length or more along an edge 114 of snowboard. In general, channel 124 may comprise a continuous, or nearly continuous curved or substantially surface or groove formed in snowboard 100 for a preselected depth into the structure of snowboard 100. In some points, channel 124 generally may have a more shallow depth at one or more locations, and generally may have a greater depth at one or more other locations. In some embodiments, channel 124 may have one or more discontinuities along one or more edges 114 thereof. It should be noted that channel 124 is not limited to a curved shape, and other shapes may likewise be provided for channel 124 at one or more points along its length, such as rectilinear, angular, elliptical, oval, hexagonal, serrated, toothed, rippled, bumped, ridged, random formations, and so on, and the scope of the claimed subject matter is not limited in this respect.

Figure 5:
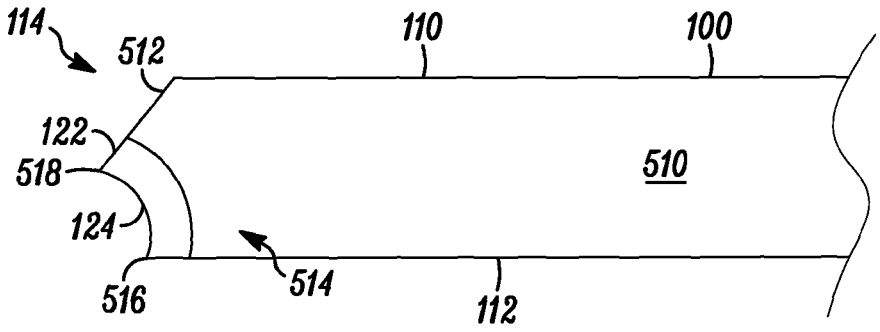
FIG. 5 is an elevation view of a curved channel formed in a snowboard or ski in accordance with one or more embodiments.

Referring now to FIG. 5, an elevation view of a curved channel formed in a snowboard or ski in accordance with one or more embodiments will be discussed. In the embodiment shown in FIG. 5, snowboard 100 may comprise a main structure 510 from which snowboards are typically manufactured. For example, main structure 510 may comprise wood, fiberglass, resin, plastic, carbon fiber, and so on, in one or more layers or cores that are not shown and which may be known to those of skill in the art of snowboard manufacturing, and the scope of the claimed subject matter is not limited in this respect. As shown in FIG. 5, channel 124 may be formed in edging 122 itself. Edging 122 may be disposed along a lower portion of snowboard 100 at or near bottom 122 of snowboard. Edge 114 of snowboard 100 may have a generally downward slope 512, and edging 122 may be disposed at the lower end of the downward slop 512. As a result, channel 124 is generally disposed downwardly toward the bottom 112 of snowboard at an angle that is the same or similar to the angle of downward slope 512. In this embodiment, channel 124 is directed downward such that when the user tilts the snowboard 100 down at the left edge 114, for example to make a left turn, channel 124 may be pushed down to contact the snow during the turn, and may provide a lesser amount of contact with the snow when the snowboard 100 is leveled out, for example after the turn is completed. By angling channel 124 downward, channel 124 may contact the snow when snowboard 100 is tilted by the user at an optimal or nearly optimal angle for turning. In some embodiments, the amount of downward tilt of channel 124 may be based at least in part on the intended level of skill of the user, and/or based at least in part on an intended use of the snowboard 100. For example, for slalom type applications, channel 124 may be tilted down at a greater angle in order to grip the snow sooner during a turn and to provide faster gripping and control during turns. Likewise, for racing type applications, channel 124 may be tilted down at less of an angle to grip the snow so that the channel is not as effective except when the user wants to make a more extremely sharp turn but otherwise does not contact the snow as much when the user wants to make a more shallow turn. Other applications and/or maneuvers for which edge 114 may be optimized may include, but are not limited to, racing or alpine riding, freestyle riding, free riding, grinding, railing, or snow park riding, all mountain riding, or split riding, or combinations thereof. Furthermore, in one or more embodiments the edge 114 of snowboard 100 is comprises multiple channel edges such as channel edge 516 and channel edge 518 so that an some edge is provided to engage with snow or other medium as snowboard 100 is tilted over a greater range of angles. Thus one channel 124 may correspond to two channel edges to provide two effective points of grip of snowboard 100 with the medium such as the snow, ice, water, and so on. Furthermore, channel 124 may allow the medium to pass along edge 114 of snowboard 100 by providing a path through which the medium may travel or otherwise be directed. Likewise channel edges 516 and/or 518 may be sharpened by the user to maintain a desired edge sharpness and/or shape, for example where edging 122 comprises a metal or similar material. Likewise, channel edges 516 and/or 518 may be dulled or detuned to allow desired amount of sliding for example for performing grinding type maneuvers. Such a multiple channel edge arrangement helps to facilitate grip and control of the medium in which snowboard is travelling at greater angles of tilt of snowboard 100, for example during more extreme maneuvers of snowboard 100 by the user, for example turning and/or slowing or stopping. It should be known that when a channel 124 is discussed herein as contacting or engaging a medium such as snow, ice, water, and so on, that such contacting or engaging may include having one or more channel edges contacting or engaging the medium, even if not specifically referenced. However, these are merely examples of the applications of channel 124 at an angle and/or a greater range of angles of tilt of snowboard 100, for example based at least in part on the application or use of snowboard 100, and/or the skill of the user, and the scope of the claimed subject matter is not limited in this respect.

Figure 6:
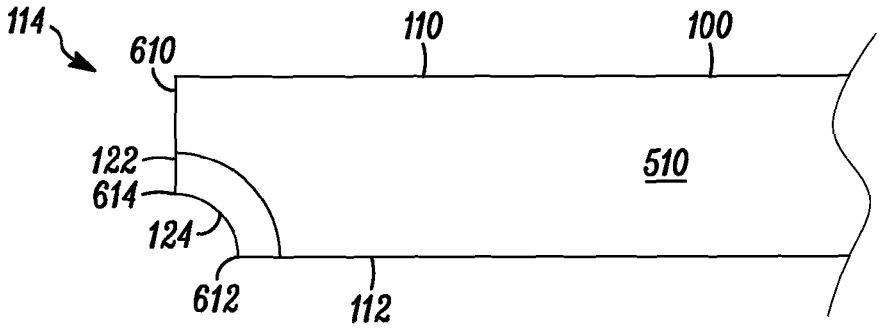
FIG. 6 is another elevation view of a curved channel formed in a snowboard or ski in accordance with one or more embodiments.

Referring now to FIG. 6, another elevation view of a curved channel formed in a snowboard or ski in accordance with one or more embodiments will be discussed. As shown in FIG. 6, snowboard 100 and channel 124 is substantially similar as shown in FIG. 5, except that instead of a downward slope 512 as shown in FIG. 5, edge 114 of snowboard 100 may have a corner 610 shape or the like. Corner 610 may be provided for simpler construction of snowboard 100, and/or to provide greater structural strength at edge 114, depending on the material out of which snowboard 100 is made, for example to provide greater strength for more extreme applications of snowboard 100 wherein greater forces may be applied to edge 114, for example at channel edge 612 and/or channel edge 614. However, this is merely another example of how edge 114 and channel 124 may be designed, and the scope of the claimed subject matter is not limited in this respect.

Figure 7:
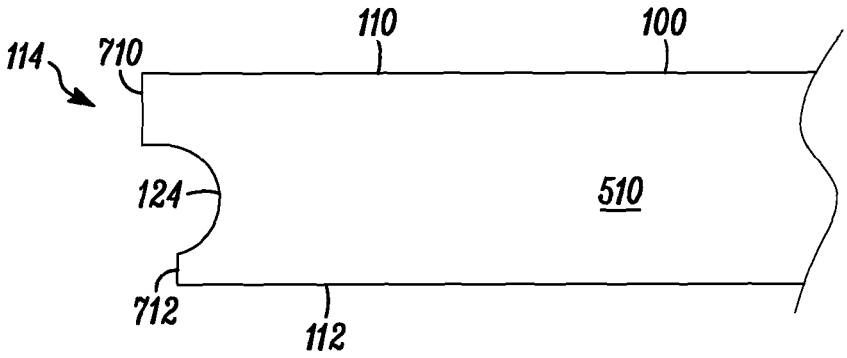
FIG. 7 is another elevation view of a curved channel formed in a snowboard or ski in accordance with one or more embodiments.

Referring now to FIG. 7, another elevation view of a curved channel formed in a snowboard or ski in accordance with one or more embodiments will be discussed. FIG. 7 shows yet another embodiment of how channel 124 may be formed in an edge 114 of snowboard. In the embodiment shown in FIG. 1, edge 114 generally may comprise first corner 710 and second corner 712, wherein channel 124 may be disposed between first corner 710 and second corner 712. As shown in FIG. 7, the second corner 712 may be the lower corner disposed near bottom 112 of snowboard 100 an may be generally recessed with respect to first corner 710 disposed near top 100 of snowboard 100. In one or more embodiments, in such an arrangement channel 124 may be more exposed near bottom 112 of board so that channel 124 may contact the snow sooner than if the second edge 712 were not so recessed. In some embodiments, channel 124 may further be angled downward with respect to the generally plane of snowboard 100 to further cause channel 124 to optimally or nearly optimally contact the snow. However, these are merely examples of the arrangement of first corner 710, second corner 712, and/or channel 124, and the scope of the claimed subject matter is not limited in these respects.

Figure 8:
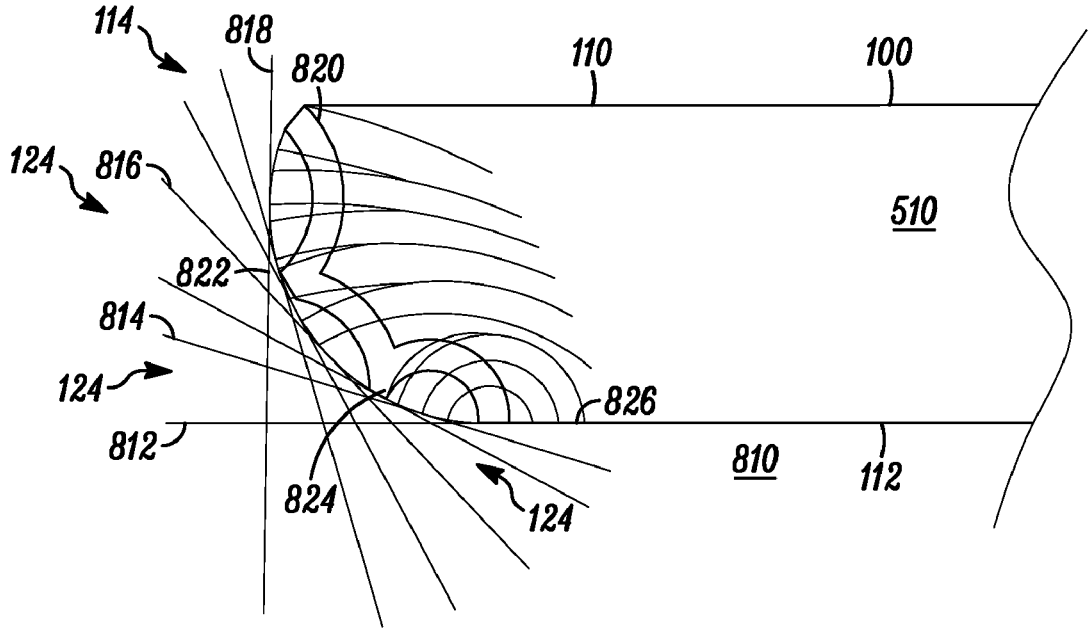
FIG. 8 is an elevation view of multiple curved channels formed in a snowboard or ski in accordance with one or more embodiments.

Referring now to FIG. 8, an elevation view of multiple curved channels formed in a snowboard or ski in accordance with one or more embodiments will be discussed. As shown in FIG. 8, edge 114 of snowboard 100 may comprise two or more channels 124, in this example three channels 124. When snowboard 100 is generally parallel to the medium 810 in or on which snowboard 100 is traveling, for example snow, then none of the channels 124 may be substantially engaged with medium 810. However, it is possible that one or more of channels 124 may be at least partially engaged with medium 810. When the user tilts snowboard 100 to a first angle 814 with respect to the plane 812 of medium 810, then a first one of the channels 124 located near bottom 112 may be substantially engaged with medium 810. If the user tilts the snowboard 100 to a greater angle, such as second angle 816, then the second channel 124 in the middle may be substantially engaged with medium 810. Likewise, if the user tilts the snowboard 100 to an event greater angle, such as third angle 816, then the third channel 124 near top 110 may be substantially engaged with medium 810. In such a multi-channel arrangement of snowboard 100 as shown in FIG. 5, at least one or more channels 124 may be at least partially and/or substantially engaged with medium 810 as the user tilts the snowboard 100 at greater and greater angles with respect to the surface plane 812 of medium 810. As can be seen in FIG. 8, and as discussed with respect to FIG. 5, above, the three channels 124 of the edge 114 of snowboard 100 may provide four points of contact or grip with medium 510 via four corresponding channel edges 820, 822, 824, and 826. However this is merely one example of a multi-channel, multi-edge grip arrangement of snowboard 100, and the scope of the claimed subject matter is not limited in these respects.

Figure 9:
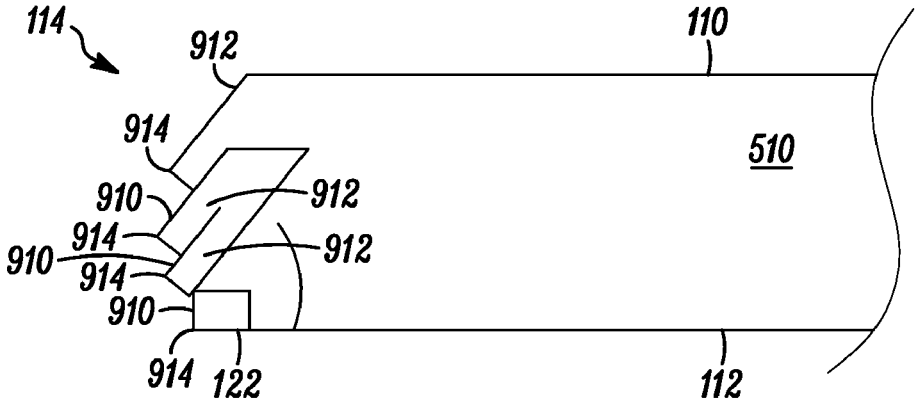
FIG. 9 is an elevation view of one or more rectilinear edge elements formed in a snowboard or ski in accordance with one or more embodiments.

Referring now to FIG. 9, an elevation view of one or more rectilinear edge elements formed in a snowboard or ski in accordance with one or more embodiments will be discussed. In the embodiment shown in FIG. 9, edge 114 of snowboard 100 may comprise a primary edging 122 and one or more secondary edge elements which may comprise rectilinear edge elements 912 as shown in FIG. 9. In the embodiment of FIG. 9, rectilinear edge elements 912 function to provide one or more channels 910 and/or one or more channel edges 914 that correspond to the corners of the one or more edge elements 912. Thus, multiple channels 910 and/or multiple channel edges 914 may be provided by one or more edge elements 912. In one or more embodiments, primary edging 122 may comprise a first material, such as metal or steel, and one or more secondary edge element comprising rectilinear edge elements 912 may comprise a more flexible, shock absorbing material such as rubber or other material. Thus, in one or more embodiments, primary edging 122 may be used for engaging with medium 510 during turns or other maneuvers when the snowboard 100 is tilted at more shallow angles, and one or more secondary edge elements such as rectilinear edge elements 912 may be used for engaging with medium 510 during turns or other maneuvers when the snowboard 100 is tilted at more extreme angles. Furthermore, when snowboard 100 is tilted at more extreme angles, one or more of the secondary edge elements may provide a shock absorbing function. The amount of shock absorbing function provided by the secondary edge elements may be selected, for example, based at least in part on the type of medium on which snowboard is intended to be used, for example less shock absorption for snow, more shock absorption for ice, and so on. The amount of shock absorption may also be selected based at least in part on the desire, style, and/or skill of the user. It should also be noted that although FIG. 9 shows the secondary edge elements as comprising one or more rectilinear elements 912, the secondary edge elements may have other shapes such as oval, elliptical, circular, triangular, rhomboidal, pyramidal, and so on. Furthermore, in one or more embodiments primary edging 122 may be omitted and edge 114 may comprise just one or more of the secondary edge elements as the main or only edge elements. However, these are merely example designs of primary edging 122 and/or secondary edge elements, and the scope of the claimed subject matter is not limited in these respects.

Figure 10:
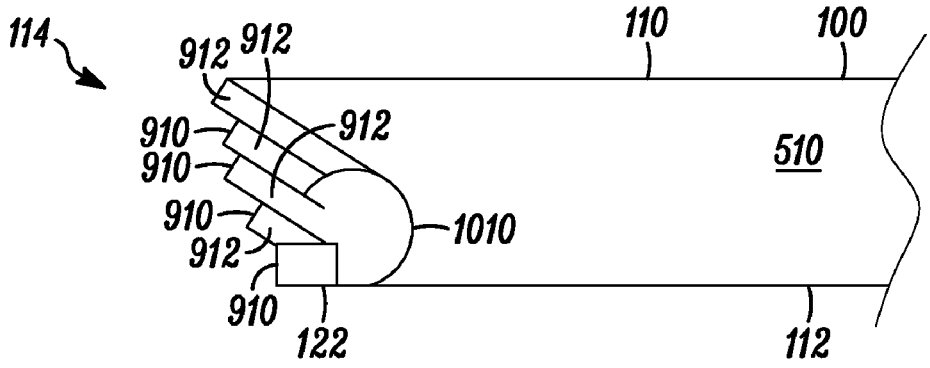
FIG. 10 is an elevation view of one or more upwardly angled rectilinear edge elements formed in a snowboard or ski in accordance with one or more embodiments.
Figure 11:
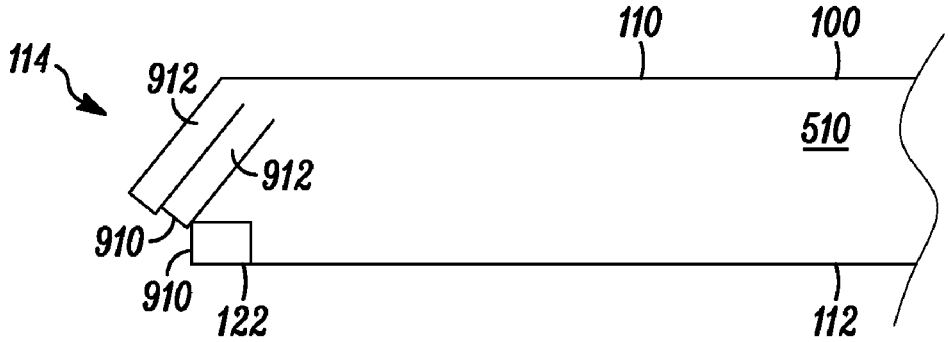
FIG. 11 is an elevation view of one or more downwardly angled rectilinear edge elements formed in a snowboard or ski in accordance with one or more embodiments.

Referring now to FIG. 10 and FIG. 11, an elevation view of one or more upwardly angled rectilinear edge elements and one or more downwardly angled rectilinear elements, respectively, formed in a snowboard or ski in accordance with one or more embodiments will be discussed. As shown in FIG. 10, edge elements 912 may be oriented upwardly toward the top 110 of snowboard. Likewise, as shown in FIG. 11, edge elements 912 may be oriented downwardly toward the bottom 112 of snowboard 100. Furthermore, in one or more embodiments as shown for example in FIG. 10, edge elements 912 may be enveloped within cavity 1010 so that edge elements 912 have freedom of movement into and/or out of the region of cavity 1010. In one or more embodiments, cavity 1010 may be filled with a material, or alternatively may comprise a material that provides and additional shock absorbing function and or control. In one particular embodiment, the material disposed in cavity 1010 may be the same material and may be contiguous with the material of edge elements 912, that is comprise a unitary structure. In other embodiments, edge elements 910 may comprise a harder material such as metal, steel, plastic, carbon fiber, and so on, where the elements are abutting or otherwise affixed to the material disposed in cavity 1010 wherein the material in cavity 1010 provides shock absorbing properties for edge elements 912, and/or flexing or expansion control for edge elements 912. However, these are merely examples of edge elements 912, cavity 1010, and/or fill material in cavity 1010, and the scope of the claimed subject matter is not limited in these respects.

Figure 12:
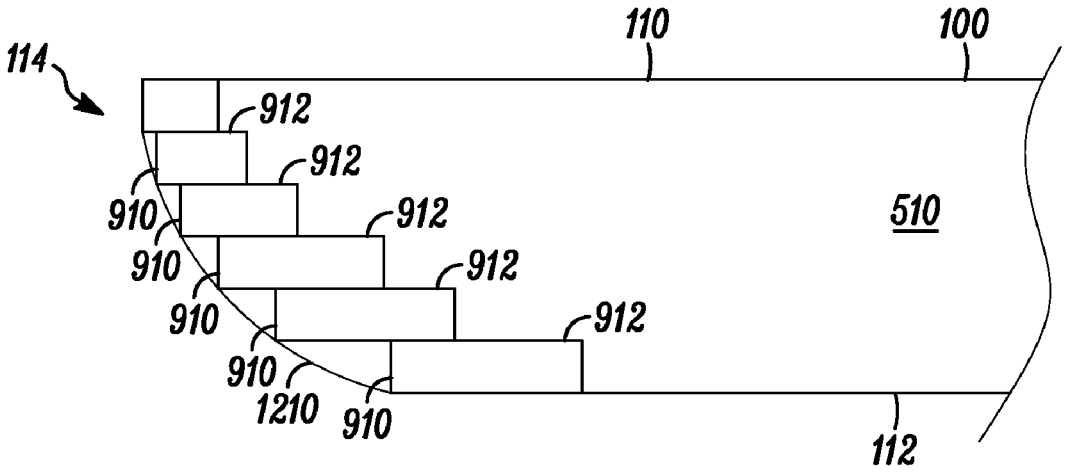
FIG. 12 is an elevation view of one or more generally parallel rectilinear edge elements formed in a snowboard or ski in accordance with one or more embodiments.

Referring now to FIG. 12, an elevation view of one or more generally parallel rectilinear edge elements formed in a snowboard or ski in accordance with one or more embodiments will be discussed. In one or more embodiments, the arrangement of edge elements 912 may selected to provide an overall profile 1210 to edge 114. For example, as shown in FIG. 12, profile 1210 may comprise a curve or gradual curve via gradual extension of one edge element 912 to the next edge element 912. In other embodiments other profiles 1210 may likewise be provided for example to adjust how soon the next edge elements engage the medium 510 as snowboard 100 is tilted upward by the user. In some embodiments, profile 1210 may comprises a stepped profile comprising two or more macro steps where a macro step may comprise to or more edge elements. Multiple other curved or non-curved profiles 1210 may likewise be implemented. Furthermore, although FIG. 12 shows edge elements 912 as being generally parallel to a surface or plane of snowboard 100, in some embodiments edge elements may be angled upwardly or downwardly as shown in FIG. 10 or FIG. 11, respectively. However, these are merely example arrangement of profile 1210 of edge 114, and the scope of the claimed subject matter is not limited in these respects.

Figure 13:
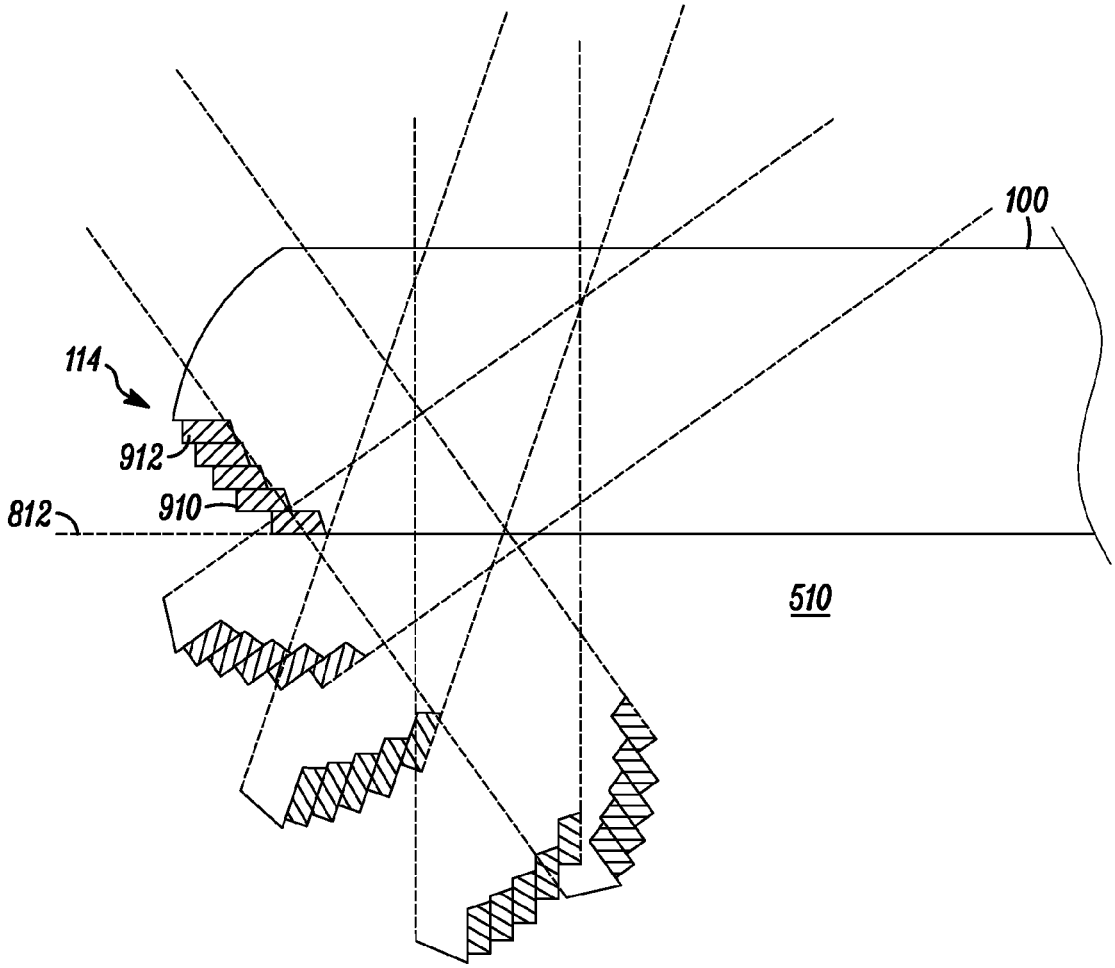
FIG. 13 is an elevation view of one or more rectilinear edge elements formed in a snowboard or ski to provide traction for rotated positions in accordance with one or more embodiments.

Referring now to FIG. 13 is an elevation view of one or more rectilinear edge elements formed in a snowboard or ski to provide traction for rotated positions in accordance with one or more embodiments will be discussed. As shown in FIG. 13, as snowboard 100 is tilted at greater angles with respect to surface plane 812 of medium 510, edge elements 912 and/or channel elements 910 may provide greater engagement with medium 510 with ever increasing angles of tilt of snowboard 100. Such an arrangement of multiple channel elements 910 and/or multiple edge elements 912 may provide the user with greater control of snowboard 100 during maneuvers. However, this is merely one example of the engagement of multiple channel elements 910 and/or multiple edge elements 912 as a function of rotational or tilt angle of snowboard 100 with respect to surface plane 812 of medium, and the scope of the claimed subject matter is not limited in these respects.

Figure 14:
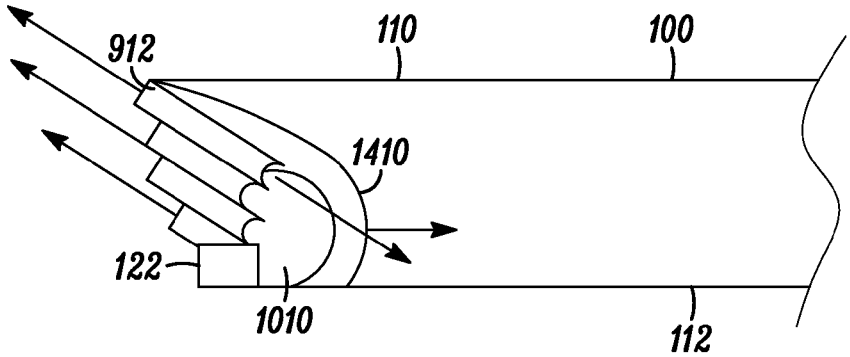
FIG. 14 is an elevation view of one or more flexible edge elements formed in a snowboard or ski to provide traction in accordance with one or more embodiments.
Figure 15:
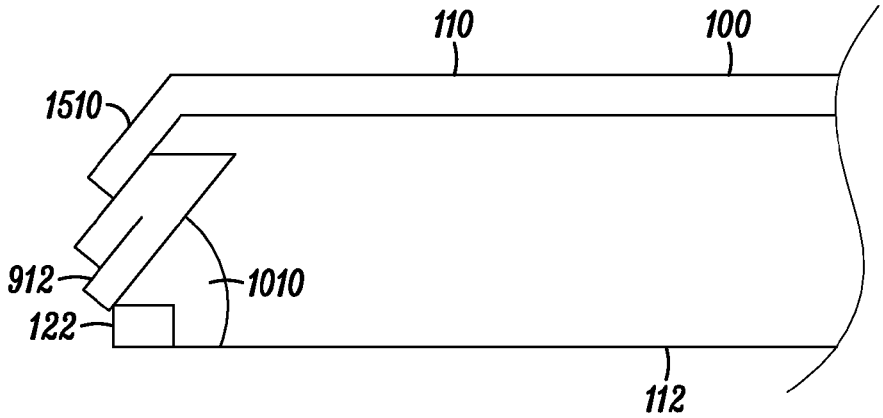
FIG. 15 is an elevation view of one or more edge elements formed in a snowboard or ski along with a surface element in accordance with one or more embodiments.
Figure 16:
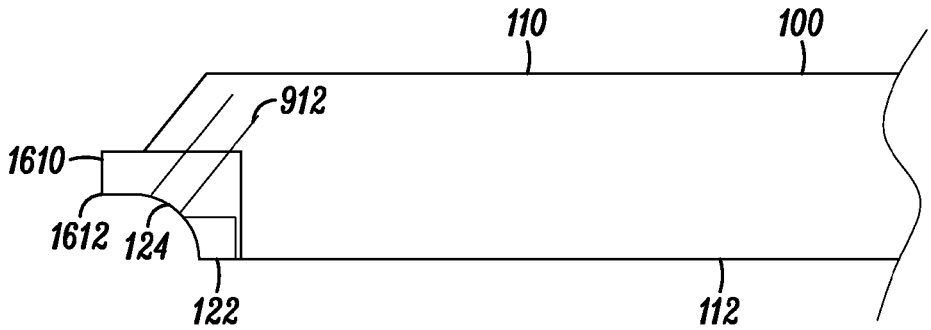
FIG. 16 is an elevation view of one or more protruding edge elements formed in a snowboard or ski in accordance with one or more embodiments.

Referring now to FIG. 14, FIG. 15, and FIG. 16, elevation views of one or more flexible edge elements formed in a snowboard or ski in accordance with one or more embodiments will be discussed. As shown in FIG. 14, the arrangement of edge elements 912 may be substantially similar to that shown in FIG. 10, but further including a sidewall 1410 to which one or more of the edge elements 912 may be attached. Sidewall 1410 may comprise a rigid material such as steel or plastic, or alternatively may comprise a shock absorbing material such as rubber to allow one or more edge elements 912 to generally move in one or more directions as indicated by the arrows due to the flexing of sidewall 1410. As shown in FIG. 15, one or more edge elements 912 may be sandwiched between and/or may abut primary edging 122 and/or an additional edging 1510, or biding or layer of snowboard 100, for example to facilitate the holding of or to prevent freedom of movement of edge elements in one o more directions. As shown in FIG. 16, primary edging 122 and/or one or more edge elements 912 may be at least partially or wholly enveloped by gasket 1610 which may comprise a flexible shock absorbing material such as a rubber material or the like to provide a flexible, shock absorbing channel 124 and/or channel edge 1612, wherein edging 122 may provide some structural strength to gasket 1610. However, these are further example arrangements of channels 124 and/or edge elements 124, and the scope of the claimed subject matter is not limited in these respects.

Figure 17:
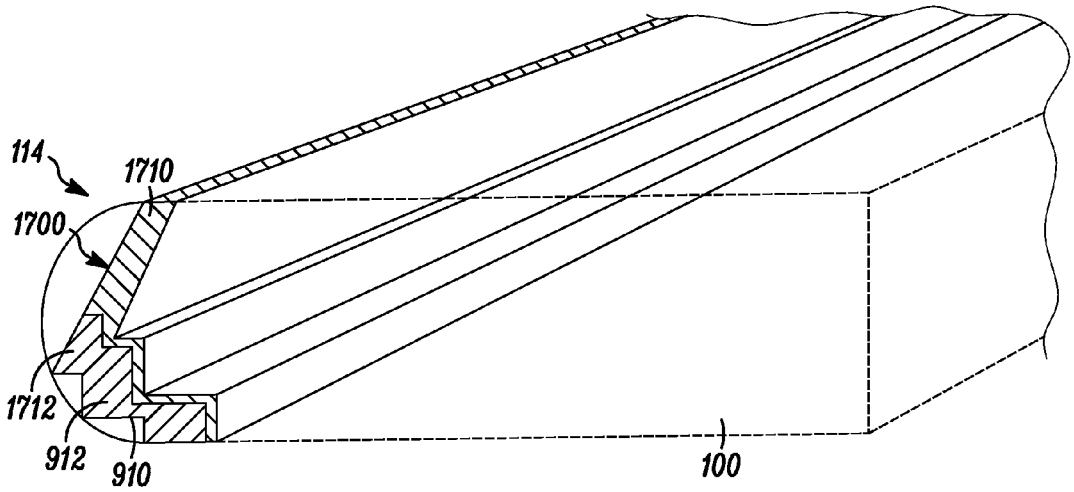
FIG. 17 is a cut away view of one or more edge elements formed in a snowboard or ski in accordance with one or more embodiments.

Referring now to FIG. 17 is a cut away view of one or more edge elements formed in a snowboard or ski in accordance with one or more embodiments will be discussed. As shown in FIG. 17, edge 114 of snowboard 100 may comprise a metal jacket 1700. In one or more embodiments, metal jacket 1700 may substantially and/or completely comprise a metal material, and in one particular embodiment metal jacket 1700 may comprise a first metal material 1710 and a second metal material 1712. For example, first metal 1710 material may comprise a metal alloy and second metal material 1712 may comprise steel or steel alloy. Alternatively, first metal material 1710 may comprise steel or a steel allow and second metal 1712 material may comprise a metal alloy. For example, first metal material 1710 may comprise a flexible metal material having a flexibility selected by its material properties, for example aluminum or an aluminum alloy. Second metal material 1712 may comprise a harder metal affixed or coupled to first metal material to provide strength, hardness, and/or durability, and to provide a desired shape to one or more channels 910 and/or one or more edge elements 912 as desired. Although in one or more embodiments first metal material 1710 or second metal material 1712 may comprise a metal or metal alloy, in some embodiments either or both of first metal material 1710 or second metal material 1712 may alternatively comprise a non-metallic material having similar material properties to metal in terms of strength, durability, and/or flexibility, for example a carbon fiber material. In one or more embodiments, either or both of first metal material 1710 or second metal material 1712 may alternatively comprise a non-metallic material such as plastic or rubber or the like. However, these are merely examples of one or more embodiments of an edge 114 of snowboard 100 comprising a jacket or metal jacket 1700, and the scope of the claimed subject matter is not limited in these respects.

Figure 18:
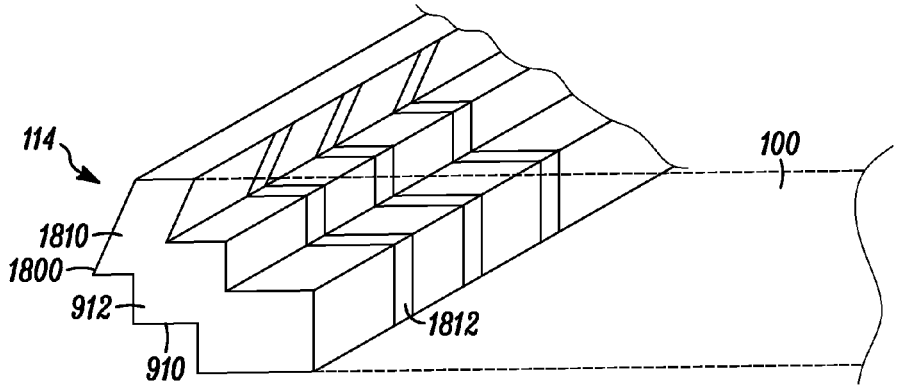
FIG. 18 is a cut away view of one or more edge elements formed along with one or more flexure elements in a snowboard or ski in accordance with one or more embodiments.

Referring now to FIG. 18 is a cut away view of one or more edge elements formed along with one or more flexure elements in a snowboard or ski in accordance with one or more embodiments will be discussed. As shown in FIG. 18, edge 114 may comprise a segmented jacket 1800 comprising a first material 1810 in some segments and a second material 1812 in other or alternating segments interspersed between segments of the first material 1810. For example, the first material 1810 may comprise a harder material such as a metal, metal allow, steel, plastic, carbon fiber and so on in one or more segments. The second material may comprise a softer, more flexible material 1812 such as plastic or rubber in one or more other segments interspersed between at least some of the segments of the first material 1810. Such an arrangement of jacket 1800 may impart strength and stability to edge 114 and its respective channels 910 and/or edge elements 912 via a harder and stronger material for first material 1810, and also provide flexibility and or torsional flexibility to snowboard 100 via a softer and more flexible material for second material 1812. In some embodiments, second material 1812 may selected to provide a desired amount of expansion and compression properties according to the intended application of snowboard 100 and/or the skill level and/or experience of the user, and/or alternatively based on the medium in which snowboard will be used, and the scope of the claimed subject matter is not limited in these respects.

Although the claimed subject matter has been described with a certain degree of particularity, it should be recognized that elements thereof may be altered by persons skilled in the art without departing from the spirit and/or scope of claimed subject matter. It is believed that the subject matter pertaining to a snowboard or ski or the like having a channeled edge or multiple element edge and/or many of its attendant utilities will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed is:

1. An apparatus, comprising:

a base body having at least one edge, a top surface and a bottom surface;

wherein the edge comprises at least two or more channels formed therein to provide two or more edge elements to contact a medium during use;

the edge having a cavity formed therein;

a sidewall disposed in the cavity, wherein the edge elements are attached to the sidewall, the sidewall comprising a shock absorbing material, wherein the two or more edge elements may move into or out of the cavity due to flexing of the sidewall;

wherein the two or more channels engage the medium as the base body is tilted at greater angles with respect to a planar surface of the medium.

2. An apparatus as claimed in claim 1, wherein the channel is curved, rectilinear, triangular, pyramidal, or serrated.

3. An apparatus as claimed in claim 1, further comprising an edging material disposed along the at least one edge, wherein the two or more channels are formed in the edging material.

4. An apparatus as claimed in claim 1, wherein an edge element near the top surface of the base body extends outward to a greater extent than an edge element near the bottom surface of the base body.

5. An apparatus as claimed in claim 1, wherein a first edge element near the bottom surface of the base body engages the medium and the second element near the top surface of the base body does not engage the medium if the base body is tilted at shallower angles with respect to a planar surface of the medium, and the second edge element engages the medium of the base body is tilted at greater angles with respect to the planar surface of the medium.

6. An apparatus as claimed in claim 1, further comprising an edging material disposed along the at least one edge, wherein the channel is formed in the edging material, the edging material comprising a material capable of being sharpened or detuned.

7. An apparatus as claimed in claim 1, further comprising an edging material disposed along the at least one edge, and a gasket at least partially enveloping the edging material, the least two or more channels formed in the gasket and the gasket embodying the two or more edge elements.

8. An apparatus as claimed in claim 1, wherein the edge comprises a primary edging disposed along the edge, the two or more edge elements being disposed adjacent to the primary edging.

9. An apparatus as claimed in claim 1, wherein one or more of the two or more edge elements comprise a shock absorbing material.

10. An apparatus as claimed in claim 1, the edge comprising a metal jacket, and the two or more edge elements being formed in the metal jacket.

11. An apparatus as claimed in claim 1, wherein the two or more edge elements are tilted upward toward the top surface of the base body, or tilted downward toward the bottom surface of the base body, or are generally parallel with respect to a plane of the base body.

12. An apparatus as claimed in claim 1, wherein the two or more edge elements are generally disposed along an edge profile from near the top surface to near the bottom surface.

13. An apparatus as claimed in claim 1, further comprising the sidewall disposed adjacent to the two or more edge elements, the sidewall comprising a flexible material to at least partially control movement of the two or more edge elements.

14. An apparatus, comprising:

a base body having at least one edge, a top surface and a bottom surface;

wherein the edge comprises at least two or more channels formed therein to provide two or more edge elements to contact a medium during use;

the edge having a cavity formed therein;

a sidewall disposed in the cavity, wherein the edge elements are attached to the sidewall, the sidewall comprising a shock absorbing material, wherein the two or more edge elements may move into or out of the cavity due to flexing of the sidewall;

wherein a first channel near the bottom of the base body engages the medium and an edge element of a second channel near the top of the base body does not engage the medium if the base body is tilted at shallower angles with respect to a planar surface of the medium, and the edge element of the second channel engages the medium if the base body is tilted at greater angles with respect to the planar surface of the medium.

15. An apparatus as claimed in claim 14, wherein a greater number of channels engage the medium as the base body is tilted at greater angles with respect to a planar surface of the medium.

* * * * *